US010076221B2

(12) United States Patent
Cook

(10) Patent No.: US 10,076,221 B2
(45) Date of Patent: Sep. 18, 2018

(54) CLEANING DEVICE FOR BATHROOM CLEANING APPLICATIONS

(71) Applicant: Natasha Cook, North Chesterfield, VA (US)

(72) Inventor: Natasha Cook, North Chesterfield, VA (US)

( * ) Notice: Subject to any disclaimer, the term of this patent is extended or adjusted under 35 U.S.C. 154(b) by 277 days.

(21) Appl. No.: 15/018,492

(22) Filed: Feb. 8, 2016

(65) Prior Publication Data

US 2017/0225317 A1 Aug. 10, 2017

(51) Int. Cl.

| | |
|---|---|
| ***A47L 13/257*** | (2006.01) |
| ***A47L 13/16*** | (2006.01) |
| ***A47L 13/11*** | (2006.01) |
| ***B25G 1/04*** | (2006.01) |
| ***A47L 13/254*** | (2006.01) |
| ***B25G 3/30*** | (2006.01) |

(52) U.S. Cl.

CPC ..... *A47L 13/257* (2013.01); *A47L 13/11* (2013.01); *A47L 13/16* (2013.01); *A47L 13/254* (2013.01); *B25G 1/04* (2013.01); *B25G 3/30* (2013.01)

(58) Field of Classification Search

CPC ..... A47L 13/10; A47L 13/11; A47L 13/16; A47L 13/20; A47L 13/24; A47L 13/254; A47L 13/256; A47L 13/257; A46B 7/06; A46B 2200/30; A46B 2200/3033; A46B 2200/304; A47K 11/10; B25G 1/04

USPC ..... 15/144.3, 144.4, 121, 201, 209.1, 210.1, 15/147.1, 147.2, 228, 229.11, 229.13, 15/244.1–244.3, 245

See application file for complete search history.

(56) References Cited

U.S. PATENT DOCUMENTS

| | | | | | |
|---|---|---|---|---|---|
| 2,648,086 | A * | 8/1953 | Vidal | A47L 13/257 | 15/119.2 |
| 2,722,031 | A * | 11/1955 | Bressler | A46B 5/0025 | 15/201 |
| 2,818,291 | A * | 12/1957 | Corns | B25G 1/04 | 15/144.1 |
| 2,865,036 | A * | 12/1958 | Poritz | A47L 13/146 | 15/119.2 |
| 3,012,265 | A * | 12/1961 | Courtenay | A47L 13/257 | 15/244.1 |
| 3,224,025 | A * | 12/1965 | Altrock | A47L 13/146 | 15/119.2 |
| 3,407,424 | A * | 10/1968 | Lanzarone | A47L 13/24 | 15/121 |

(Continued)

FOREIGN PATENT DOCUMENTS

| | | | |
|---|---|---|---|
| DE | 102004054863 | * | 5/2006 |
| JP | 8-522 | * | 1/1996 |

(Continued)

*Primary Examiner* — Mark Spisich

(57) ABSTRACT

A device for bathroom cleaning applications includes an extension, a head, and a cleaning utility. The extension defines an extension axis and including a first extension component and a second extension component. The head is fixedly coupled to the extension, and defines a head plane transverse to the extension axis. The head includes at least one resilient member disposed parallel to the head plane, and a receiving surface configured to receive the cleaning utility. Force applied to the extension is transmitted to the cleaning utility via the head to conform the cleaning utility to a remote surface to be cleaned.

17 Claims, 6 Drawing Sheets

(56) References Cited

U.S. PATENT DOCUMENTS

| | | | | | |
|---|---|---|---|---|---|
| 3,753,267 | A * | 8/1973 | Johnson, Sr. | A47L 13/20 | 15/144.1 |
| 4,077,083 | A * | 3/1978 | Siemund | A47L 13/257 | 15/244.1 |
| 4,554,699 | A * | 11/1985 | Simmons | A46B 5/0025 | 15/1.7 |
| 5,609,255 | A * | 3/1997 | Nichols | A47L 13/20 | 15/144.3 |
| 5,887,314 | A * | 3/1999 | Jordan, Jr. | A47L 13/12 | 15/144.3 |
| 7,086,114 | B2 * | 8/2006 | Hirse | A47L 13/146 | 15/116.2 |
| 7,127,768 | B2 * | 10/2006 | Blum | A47K 11/10 | 15/104.94 |
| 7,975,339 | B2 * | 7/2011 | Gavney, Jr. | A46B 9/005 | 15/1.7 |
| 8,528,146 | B1 * | 9/2013 | Abrahamson | A46B 5/0045 | 15/1.7 |

FOREIGN PATENT DOCUMENTS

| | | | |
|---|---|---|---|
| JP | 2001-70224 | * | 3/2001 |
| WO | 97/25899 | * | 7/1997 |

* cited by examiner

CLEANING DEVICE FOR BATHROOM CLEANING APPLICATIONS

BACKGROUND

This disclosure generally relates to cleaning utilities, and particularly to apparatuses, systems, and methods for cleaning a surface in a bathroom using a cleaning device.

Cleaning devices for cleaning bathrooms and surfaces in bathrooms, including floors, bathtubs, shower walls, and mirrors, include a handle and a cleaning tool such as a sponge. The cleaning devices often lack ease of use due to relatively short handles requiring a user to bend over or enter a wet area, such as a shower or bathtub, to use the device, or relatively long handles that limit storage options. Cleaning devices also may attach the handle to the cleaning tool using a swiveling coupling, causing much of the force applied to the cleaning device for cleaning a remote surface to be mitigated by the swivel action, or the cleaning tool may be a scrub brush; in such cases, cleaning becomes more difficult as a user may be required to repeatedly move the cleaning tool over the remote surface to effectively clean the remote surface.

SUMMARY

One implementation of the present disclosure is a device for bathroom cleaning applications. The device includes an extension defining an extension axis and including a first extension component and a second extension component. The device includes a head fixedly coupled to the extension, the head defining a head plane transverse to the extension axis. The head includes at least one resilient member disposed parallel to the head plane, and a receiving surface configured to receive a cleaning utility. Force applied to the extension is transmitted to the cleaning utility via the head to conform the cleaning utility to a remote surface to be cleaned.

In some embodiments, the device includes a rigid coupling connection the extension to the head. In some embodiments, the extension includes a threaded end received in an opening of the rigid coupling.

In some embodiments, the at least one resilient member includes a first plurality of resilient members disposed parallel to one another. The first plurality of resilient members may limit a flexibility of the head in a first direction. In some embodiments, the device includes a second plurality of resilient members disposed perpendicular to the first plurality of resilient members.

In some embodiments, the first extension component defines an opening along the extension axis. The opening may be configured to receive the second extension component.

In some embodiments, the first extension component is pivotably coupled to the second extension component.

In some embodiments, the device includes a locking mechanism configured to lock the extension components to one another.

In some embodiments, the head includes a pair of clips extending from a rim of the head. The pair of clips may be configured to restrain the cleaning utility against the receiving surface.

In some embodiments, the cleaning utility includes at least one of a sponge or a squeegee.

Another implementation of the present disclosure is a kit for bathroom cleaning applications. The kit includes a first extension component and a second extension component configured to be coupled to one another. The first extension component defines an extension axis. The kit includes a head configured to be fixedly coupled to the first extension component. The head defines a head plane transverse to the extension axis. The head includes at least one resilient member disposed parallel to the head plane, and a receiving surface configured to receive a cleaning utility. The kit includes the cleaning utility. Coupling the first extension component to the second extension component and fixedly coupling the head to the first extension component enables force applied to the second extension component to be transmitted to the cleaning utility via the head to conform the cleaning utility to a remote surface to be clean.

In some embodiments, the head includes a rigid coupling configured to receive a threaded end of the first extension component.

In some embodiments, the at least one resilient member includes a first plurality of resilient members disposed parallel to one another. The first plurality of resilient members may limit the flexibility of the head in a first direction.

In some embodiments, one of the first extension component or the second extension component defines an opening configured to receive the other of the first extension component or the second extension component.

In some embodiments, the first extension component is configured to be pivotably coupled to the second extension component.

In some embodiments, the kit includes a locking mechanism configured to lock the extension components to one another.

In some embodiments, the receiving surface includes a pair of clips extending from a rim of the head. The pair of clips may be configured to restrain the sponge against the receiving surface.

In some embodiments, the cleaning utility includes at least one of a sponge or a squeegee.

Another embodiment of the invention relates to a method of manufacturing a bathroom cleaning device. The method includes coupling a first extension component to a second extension component. The first extension component defines an extension axis. The method includes fixedly coupling a head to the first extension component. The head defines a head plane transverse to the extension axis. The method includes providing the head with at least one resilient member parallel to the head plane. The method includes providing the head with a receiving surface configured to receive a cleaning utility. The method includes receiving the cleaning utility at the receiving surface.

In some embodiments, the method includes providing the head with a rigid coupling configured to receive a threaded end of the first extension component.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the FIGURES, a cleaning device includes an extension defining an extension axis and including a first extension component and a second extension component. The device includes a head fixedly coupled to the extension, the head defining a head plane transverse to the extension axis. The head includes at least one resilient member disposed parallel to the head plane, and a receiving surface configured to receive a cleaning utility. Force applied to the extension is transmitted to the cleaning utility via the head to conform the cleaning utility to a remote surface to be cleaned, such as a remote surface of a bathroom. The extension components can extend to create an elongated handle allowing the cleaning device to reach distant surfaces while continuing to transmit force to the head to conform the head to the remote surface and efficiently clean the remote surface, and also collapse or otherwise reduce the length of the extension to facilitate storage. In some embodiments, the cleaning device is provided as an assembled device. In some embodiments, the cleaning device is provided as a kit including components to be assembled.

Figure 1:
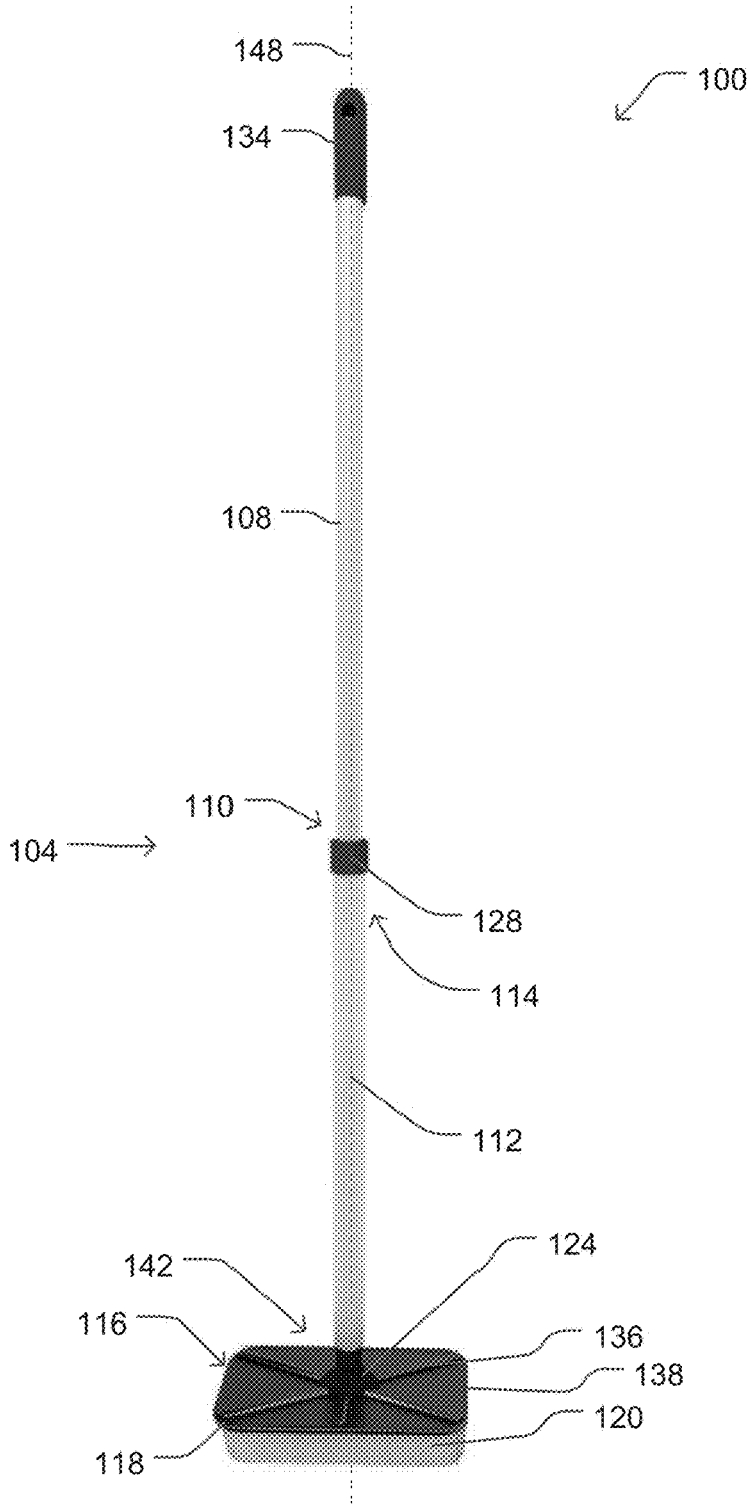
FIG. 1 is a drawing of a cleaning device include an extension rigidly coupled to a head coupled to a cleaning utility, according to an exemplary embodiment.

Referring now to FIG. 1, a cleaning device 100 is illustrated in accordance with one embodiment. The cleaning device 100 includes an extension 104 including a first extension component 108 and a second extension component 112. The extension 104 defines an extension axis 148. The extension 104 provides an elongated handle allowing the cleaning device 100 to be manipulated from a distance relative to a remote surface to be cleaned. The first extension component 108 may be coupled to the second extension component 112.

As shown in FIG. 1, the first extension component 108 includes a first end 110 and a second end 134, and the second extension component 112 includes a first end 114 and a second end 142. The first end 110 of the first extension component 108 is coupled to the first end 114 of the second extension component 112. In this manner, when the cleaning device 100 is manipulated, forces may be transferred through the extension 104 to the second end 142 of the second extension 112.

Figure 6:
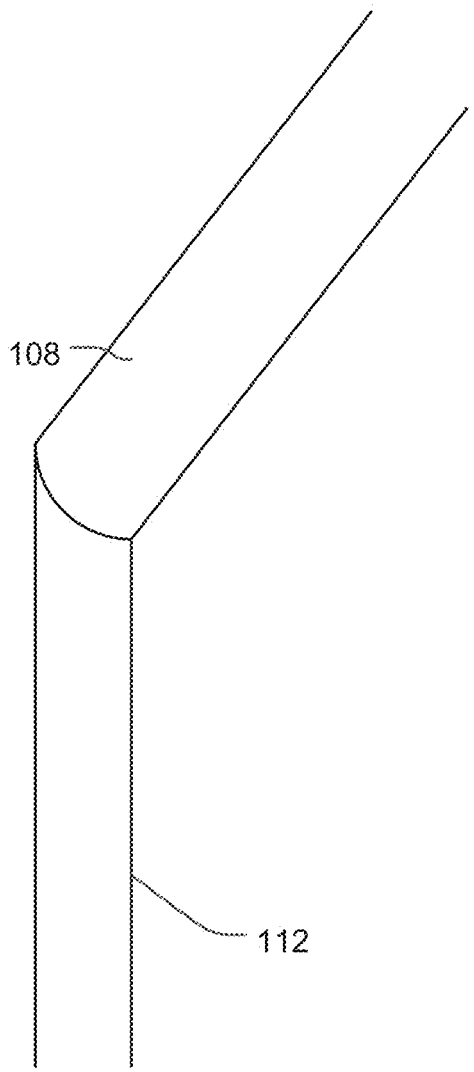
FIG. 6 is a drawing illustrating pivotable coupling of extension components, according to an exemplary embodiment.

In some embodiments, an adjustable locking mechanism 128 is provided to lock the first extension component 108 to the second extension component 112. The adjustable locking mechanism 128 can be adjusted through a continuous range of tightness states in order to frictionally lock the first extension component 108 to the second extension component 112. In some embodiments, the first extension component 108 is pivotably coupled to the second extension component 112 (e.g., FIG. 6).

In some embodiments, the second extension component 112 defines an opening configured to receive the first extension component 108. The opening allows the first extension component 108 to be collapsed or stowed inside of the second extension component 112, such as for storing the cleaning device 100. For example, the first extension component 108 may be slidingly translated along the extension axis 148 in and out of the opening. When the cleaning device 100 is to be used, the first extension component 108 may be slid out of the opening of the second extension component 112. The locking mechanism 128 may be used to lock the first extension component 108 to the second extension component 112 when the first extension component 108 is slid out of the opening of the second extension component 112 into a partially or fully extended position. In some embodiments, the extension 104 includes more than two extension components, and may include multiple openings and adjustable locking mechanisms allowing for the more than two extension components to be collapsed or stowed into one another.

The second extension component 112 is configured to be connected to a head 116 at the second end 142 of the second extension component 112. The head 116 defines a head plane transverse to the extension axis. In some embodiments, the head plane is perpendicular to the extension axis when the head 116 is connected to the second extension component 112. In some embodiments, the head plane is oblique to the extension axis. In some embodiments, the head 116 includes a coupling 124 configured to fixedly couple (e.g., connect, attach, etc.) the head 116 to the second extension component 112. In some embodiments, the coupling 124 includes a threaded opening configured to receive a threaded end of the second extension component 112 (see, e.g., FIGS. 2-4).

By fixedly coupling the head 116 to the second extension component 112 of the extension 104, the coupling 124 prevents swiveling or other changes in orientation between the head 116 relative to the extension 104. As such, force transmitted through the extension 104 to the head 116 is maximized without being redirected to changes in orientation, providing efficient scrubbing and other cleaning actions by the cleaning device 100.

In some embodiments, the coupling 124 includes a multi-position locking mechanism allowing the extension 104 to be fixed at various angles relative to the head 116. Such a multi-position locking mechanism allows the head 116 to remain rigidly fixed to the extension 104, while providing a user with more options in manipulating the cleaning device 100 for cleaning a surface. For example, the coupling 124 may include a plurality of openings parallel to the head plane, and the second extension component 112 may include a plurality of openings transverse to the extension axis 148, such that aligning select openings of the coupling 124 and the second extension component 112 allows for the head 116 and extension 104 to be fixed at various angles using bolts passed through the selected openings and locked using complementary engagement members.

The head 116 includes a receiving surface 118 configured to receive a cleaning utility 120. The receiving surface 118 may include an adhesive for adhering the cleaning utility 120 to the receiving surface 118. The receiving surface 118 may include hooks, Velcro, buttons, or other components for attaching to a reciprocal component of the cleaning utility 120. In some embodiments, the receiving surface 118 includes multiple such components, allowing a user to interchangeably operate the cleaning device 100 with multiple different cleaning utilities 120.

In some embodiments, the cleaning utility 120 includes at least one of a sponge or a squeegee (e.g., a mirror cleaning device). The cleaning utility 120 may be configured to conform to a remote surface to be cleaned. For example, the cleaning utility 120 may include a flexible or compressible sponge that conforms to the remote surface when force is transmitted from the extension 104 to the cleaning utility 120 via the head 116. In some embodiments, only the cleaning utility 120 undergoes a shape change to conform to the remote surface to be cleaned; all other components of the cleaning device 100 remain rigidly fixed relative to one another, such that maximum force is transmitted through the cleaning device 100 to the cleaning utility 120 while the cleaning utility 120 provides flexibility for conforming to contoured surfaces.

In some embodiments, the cleaning device 100 includes a hose for receiving cleaning fluids, such as from a bottle of cleaning fluid attached to the extension 104. The hose may be configured to be fluidly coupled to an opening in the head 116, such that fluid may be passed through the head 116 to the cleaning utility 120 for applying to the remote surface to be cleaned via the cleaning utility 120.

In some embodiments, a surface of the cleaning utility 120 includes frictional elements (e.g., friction pads, cloth strips, etc.) for scrubbing dirt or other material on the remote surface to be cleaned. As compared to a typical cleaning device, in which effectively using frictional elements of a cleaning utility may require directly handling the cleaning utility (e.g., by directly handling a handheld sponge such that a user's hand is positioned immediately adjacent to the remote surface to be cleaned), the cleaning device 100 allows a user to take advantage of the friction caused by the frictional elements for scrubbing the remote surface, while manipulating the cleaning utility 120 from a distance relative to the remote surface.

In some embodiments, the head 116 includes or is manufactured from rigid or resilient material, such as a rigid plastic or metal. As such, force transmitted through the extension 104 to the head 116 is maximally directed to the cleaning utility 120, and minimally directed to shape changes of the head 116. In this manner, the cleaning device 100 provides the effect of a user manipulating the head 116 directly, while handling the cleaning device 100 from a distance relative to the remote surface to be cleaned.

In some embodiments, the head 116 includes at least one resilient member 136. The at least one resilient member 136 facilitates transmission of forces applied through the extension 104 to the cleaning utility 120. For example, as shown in FIG. 1, the head 116 includes a plurality of resilient members 136 that extend outward from the coupling 124 to the rim 138 of the head 116, thus carrying force from the extension 104 to the coupling 124 and then through the head 116 out to the rim 138. In some embodiments, the head 116 includes resilient members 136 along the rim 138 of the head 116, providing further structural integrity to the head while facilitating transmission of forces to the extremities of the head 116 and the cleaning utility 120. Including resilient members 136 along the rim 138 of the head 116 may also facilitate cleaning by the cleaning utility 120, as forces applied through the extension 104 to the cleaning utility 120 are effectively transmitted to the edges of the cleaning utility 120, such edges of the cleaning utility 120 making first contact with portions of the remote surface to be cleaned as the cleaning utility 120 is moved along the remote surface.

In some embodiments, the head 116 includes or is manufactured from flexible material, such as flexible plastic or metal. As such, force transmitted through the extension 104 to the head 116 may be at least partially directed to changing the shape of the head 116 to conform the head 116 along with the cleaning utility 120 to a remote surface to be cleaned. For example, the cleaning device 100 may be used to clean a remote surface that has a contour or curvature greater than a dimension of the head 116 and the cleaning utility 120; combining rigid and flexible elements in the head 116 can thus allow the head 116 to move the cleaning utility 120 along such difficult to clean surfaces by flexing the head 116 in at least one direction. In some embodiments, the head 116 includes flexible material with rigid elements (e.g., resilient members 136) disposed parallel to one another (see, e.g., FIG. 4), allowing the head 116 to be rigid in one direction and flexible in a second direction.

Figure 2:
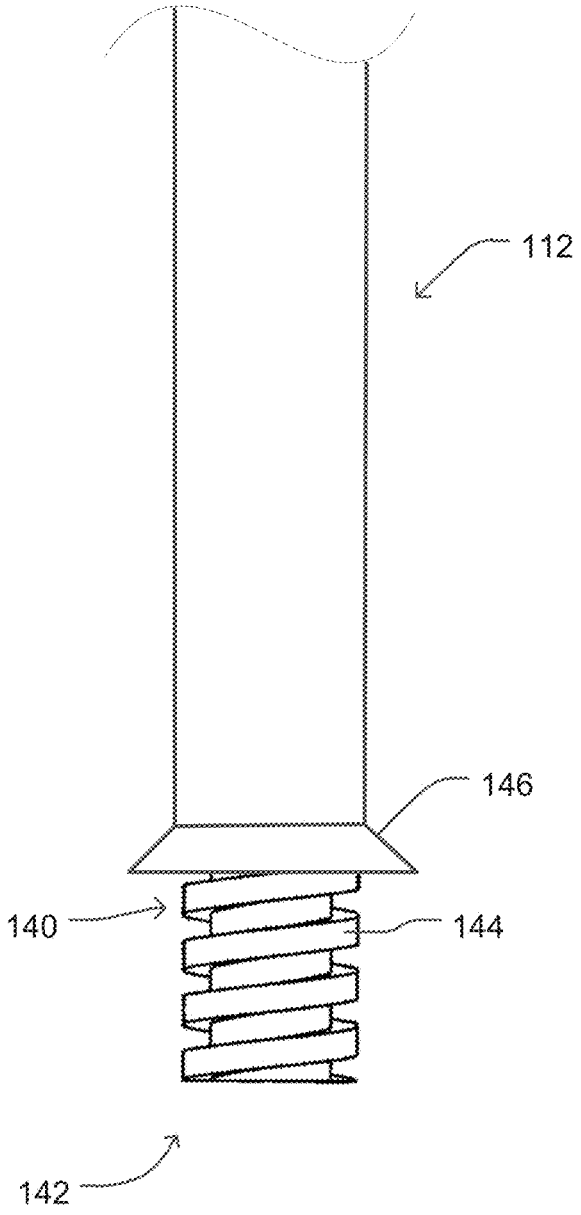
FIG. 2 is a drawing illustrating features of a portion of the extension of FIG. 1 where the extension can be coupled to the head of the cleaning utility, according to an exemplary embodiment.

Referring now to FIG. 2, the second end 142 of the second extension component 112 includes a threaded engagement member 140 having threads 144. The threaded engagement member 140 is configured to be fixedly coupled to a corresponding component of a head (e.g., coupling 124 of head 116 shown in FIGS. 1 and 3, etc.), allowing for a rigid engagement that prevents a change in orientation between the second extension component 112 and the head 116. In some embodiments, the threaded engagement member 140 includes at least two heterogeneous threadforms, allowing for the second extension component 112 to be fixedly coupled to heterogeneous couplings 124 of heads 116. In some embodiments, the second end 142 includes a flange 146. The flange 146 may extend away from the second extension component 112. The flange 146 may facilitate transmitting forces from the second extension component 112 to the head 116 by increasing the surface area of contact between the second extension component 112 and the head 116.

Figure 3:
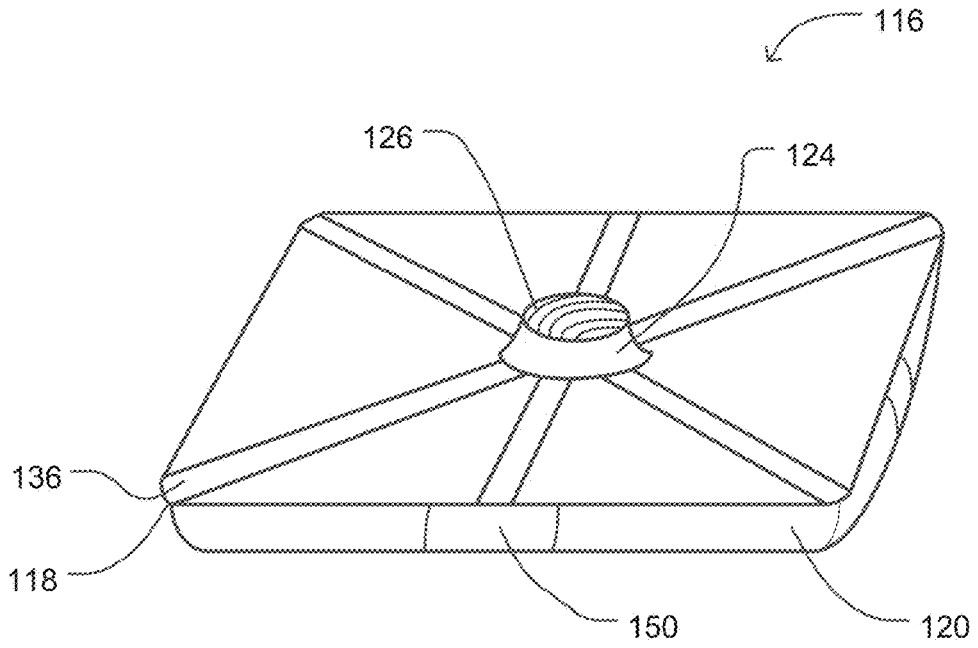
FIG. 3 is a drawing illustrating features of the head of the cleaning device of FIG. 1, according to an exemplary embodiment.

Referring now to FIG. 3, the head 116 is shown in accordance with one embodiment. The head 116 includes the coupling 124 for receiving and being coupled to the second end of the second extension (see, e.g., second end 142 of second extension 112 shown in FIG. 2). As shown in FIG. 3, the coupling 124 includes a threaded opening 126 configured to reciprocally engage the threaded end of the second extension component 112, thus rigidly securing the second extension component 112 to the head 116. In some embodiments, the opening 126 of the coupling 124 includes at least two heterogeneous threadforms, allowing for heterogeneous second extension components 112 to be fixedly coupled to the head 116.

In some embodiments, the head 116 includes retaining members 150 (e.g., clips) for receiving and retaining or restraining the cleaning utility 120 against the receiving surface 118 of the head 116. The retaining members 150 extend from the rim 138 of the head 116 to retain the cleaning utility 120. In some embodiments, the retaining members 150 are positioned adjacent to the resilient members 136, facilitating transmission of forces from the resilient members 136 to the cleaning utility 120. In some embodiments, the retaining members 150 include a lip disposed on an opposite side of the retaining members 150 from where the retaining members extend from the rim 138. The lip may extend at an angle from the retaining member 150 in a direction parallel to or substantially parallel to the head plane, in order to retain the cleaning utility 120 against the receiving surface 118.

Figure 4:
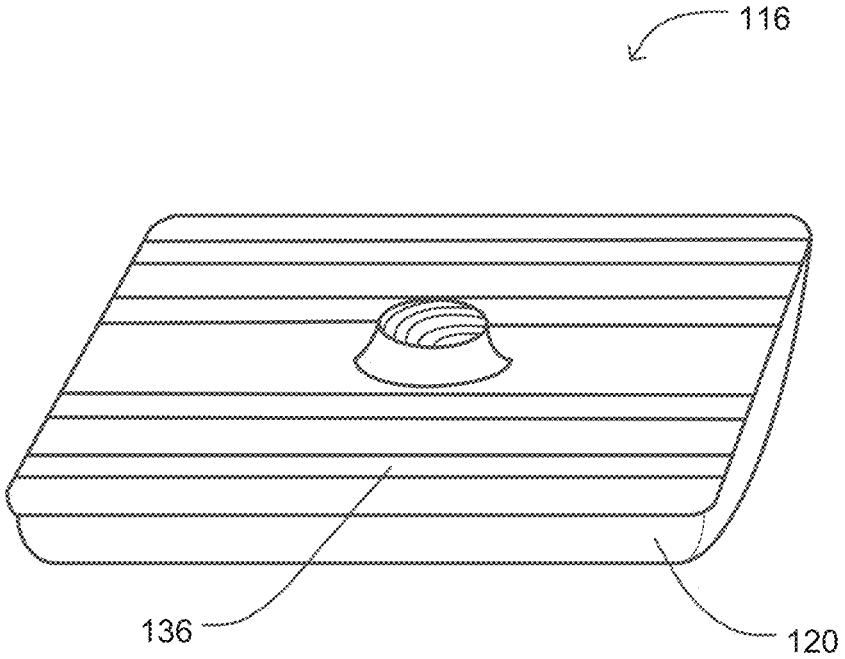
FIG. 4 is a drawing illustrating resilient members of the head of the cleaning device of FIG. 1, according to an exemplary embodiment.

Referring now to FIG. 4, the head 116 is shown in accordance with one embodiment. The head 116 includes a plurality of resilient members 136 disposed parallel to one another. The resilient members 136 limit a flexibility of the head 116 in a first direction parallel to the plurality of resilient members 136, while permitting a flexibility of the head 116 in a second direction transverse or perpendicular to the plurality of resilient members 136. For example, in certain applications, a remote surface to be cleaned may be curved in a first direction and flat or relatively flat in a second direction. By providing flexibility in a first direction and resilience in a second direction, the head 116 can effectively conform to such remote surfaces. In certain applications, a remote surface to be cleaned may have a curvature greater than a dimension of the head 116, such that allowing the head 116 to flex in a first direction allows the cleaning device 100 to still be contoured to the remote surface without sacrificing the rigidity necessary to transmit forces from the extension 104 to the cleaning utility 120. In some embodiments, the head 116 includes a second plurality of resilient members. The second plurality of resilient members may be disposed perpendicular to or otherwise at an angle relative to the plurality of resilient members 136.

Figure 5:
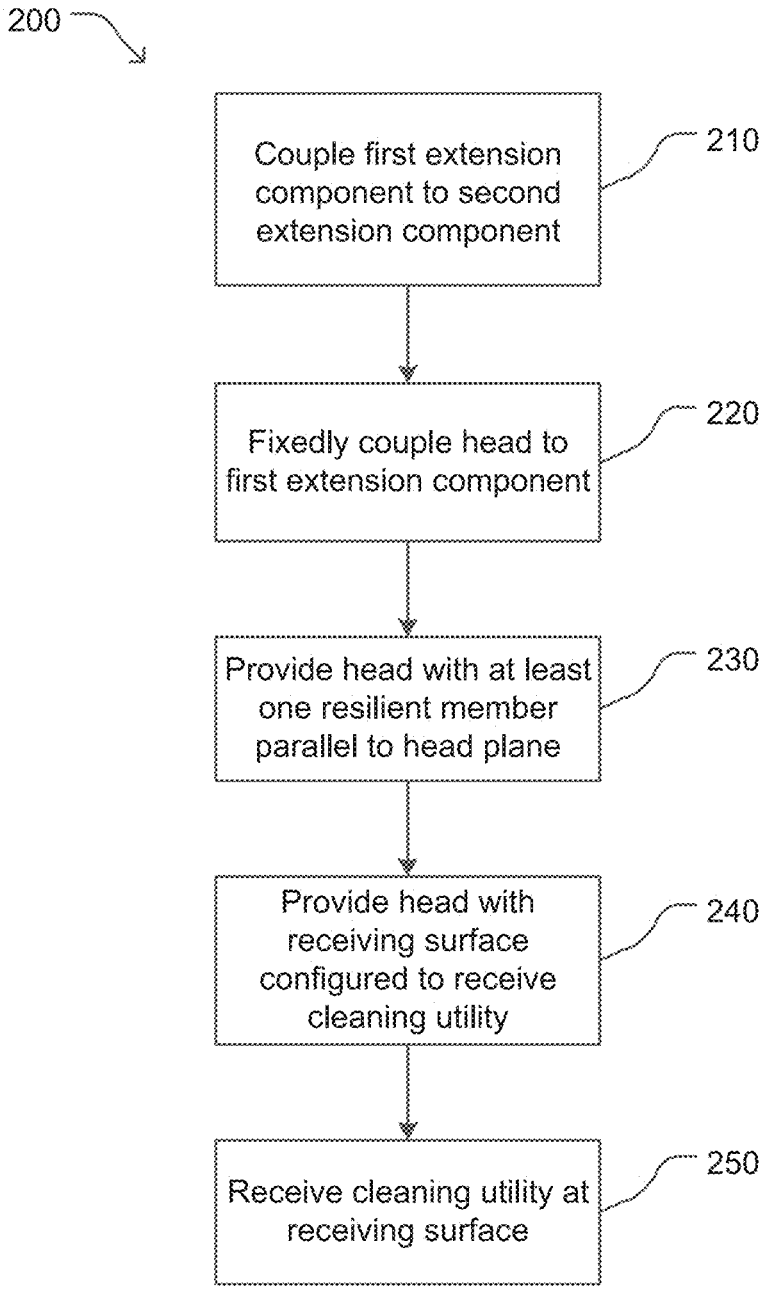
FIG. 5 is a drawing illustrating a method of manufacturing a cleaning device for bathroom cleaning applications, accordingly to an exemplary embodiment.

Referring now to FIG. 5, a method 200 of manufacturing a bathroom cleaning device is shown. The method 200 may be implemented to manufacture a cleaning device including features and/or components illustrated in FIGS. 1-4 and described herein. The method 200 may include providing components of a bathroom cleaning device constructed from a variety of materials, including rigid/resilient materials or flexible materials as appropriate for providing the structural advantages of the cleaning devices disclosed herein.

At 210, an extension is formed by coupling a first extension component to a second extension component. For example, the first extension component or the second extension component may include an opening in which the other extension component may be received. A locking mechanism may be positioned to surround the extension components and be tightened to frictionally engage the extension components to one another.

At 220, the extension is fixedly coupled to a head by connecting the first extension component to the head. For example, the first extension component may include a threaded fixture on an opposite end of the first extension component from the second extension component. The head may include a complementary threaded opening for receiving the threaded fixture of the first extension component, such that the first extension component can be threaded into the opening.

At 230, the head is provided with at least one resilient member parallel to a head plane of the head. In some embodiments, a plurality of resilient members are provided, such as by being positioned parallel to one another or extending from a central location of the head, such as from a location where the extension is connected to the head. In some embodiments, a first plurality of resilient members are provided parallel to one another in a first direction, and a second plurality of resilient members are provided in a second direction perpendicular to the first direction.

At 240, the head is provided with a receiving surface configured to receive a cleaning utility. The receiving surface may be positioned on an opposite side of the head from where the extension is connected to the head. The receiving surface may include adhesive for adhering to the cleaning utility. The receiving surface may include hooks, Velcro, buttons, or other components for attaching to a reciprocal component of the cleaning utility. The head may be provided with retaining members (e.g., clips) for restraining or retaining the cleaning utility against the receiving surface.

At 250, a cleaning utility is received at the receiving surface of the head. For example, the cleaning utility may be adhered to the receiving surface. The cleaning utility may include slots, Velcro, snaps, or other components for attaching to a reciprocal component of the receiving surface. The cleaning utility may be positioned within clips or other retaining members extending from the head.

The construction and arrangement of the elements of the cleaning device as shown in the various exemplary embodiments are illustrative only. Although only a few implementations of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Numerous specific details are described to provide a thorough understanding of the disclosure. However, in certain instances, well-known or conventional details are not described in order to avoid obscuring the description. References to "some embodiments," "one embodiment," "an exemplary embodiment," and/or "various embodiments" in the present disclosure can be, but not necessarily are, references to the same embodiment and such references mean at least one of the embodiments.

Alternative language and synonyms may be used for any one or more of the terms discussed herein. No special significance should be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

The elements and assemblies may be constructed from any of a wide variety of materials that provide sufficient strength or durability, in any of a wide variety of colors, textures, and combinations. Further, elements shown as integrally formed may be constructed of multiple parts or elements.

As used herein, the word "exemplary" is used to mean an example, instance or illustration. Any implementation or design described herein as "exemplary" is not necessarily to be construed as preferred or advantageous over other implementations or designs. Rather, use of the word exemplary is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary implementations without departing from the scope of the appended claims.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

As used herein, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The background section is intended to provide a background or context to the invention recited in the claims. The description in the background may include concepts that could be pursued, but are not necessarily ones that have been previously conceived or pursued. Therefore, unless otherwise indicated herein, what is described in the background section is not prior art to the description and claims in this application and is not admitted to be prior art by inclusion in the background section.

The invention claimed is:

1. A device for bathroom cleaning applications, comprising:

an extension defining an extension axis and including a first extension component and a second extension component; and a head defining a head plane transverse to the extension axis, the head including:

a coupling disposed in a generally central region of the head and fixedly coupling the first extension component to the head;

a plurality of resilient members disposed parallel to the head plane, each resilient member extending radially outward from the coupling to a rim of the head, each adjacent pair of resilient members defining an acute angle between them;

a receiving surface configured to receive a cleaning utility; and the cleaning utility received in the receiving surface;

wherein force applied to the extension is transmitted to the cleaning utility via the head to conform the cleaning utility to a remote surface to be cleaned.

2. The device of claim 1 wherein the coupling is rigid.

3. The device of claim 2, wherein the first extension component includes a threaded end received in an opening of the rigid coupling.

4. The device of claim 1, wherein the first extension component defines an opening along the extension axis, the opening configured to receive the second extension component.

5. The device of claim 1, wherein the first extension component is pivotably coupled to the second extension component.

6. The device of claim 1, further comprising a locking mechanism configured to lock the extension components to one another.

7. The device of claim 1, wherein the receiving surface includes a pair of clips extending from the rim of the head, the pair of clips configured to restrain the cleaning utility against the flexible receiving surface.

8. The device of claim 1, wherein the cleaning utility includes at least one of a sponge or a squeegee.

9. A kit for bathroom cleaning applications, comprising:

a first extension component and a second extension component configured to be coupled to one another, the first extension component defining an extension axis;

a head defining a head plane transverse to the extension axis, the head including:

a coupling disposed in a generally central region of the head and configured to fixedly couple the first extension component to the head;

a plurality of resilient members disposed parallel to the head plane, each resilient member extending radially outward from the coupling to a rim of the head, each adjacent pair of resilient members defining an acute angle between them; and a receiving surface configured to receive a cleaning utility;

wherein coupling the first extension component to the second extension component and fixedly coupling the head to the first extension component enables force applied to the second extension component to be transmitted to the cleaning utility via the head to conform the cleaning utility to a remote surface to be cleaned.

10. The kit of claim 9, wherein the coupling is rigid and configured to receive a threaded end of the first extension component.

11. The kit of claim 9, wherein one of the first extension component or the second extension component defines an opening configured to receive the other of the first extension component or the second extension component.

12. The kit of claim 9, wherein the first extension component is configured to be pivotably coupled to the second extension component.

13. The kit of claim 9, further comprising a locking mechanism configured to lock the extension components to one another.

14. The kit of claim 9, wherein the receiving surface includes a pair of clips extending from the rim of the head, the pair of clips configured to restrain the cleaning utility against the receiving surface.

15. The kit of claim 9, wherein the cleaning utility includes at least one of a sponge or a squeegee.

16. A method of manufacturing a bathroom cleaning device, comprising:

coupling a first extension component to a second extension component, the first extension component defining an extension axis;

fixedly coupling a head to the first extension component in a generally central region of the head, the head defining a head plane transverse to the extension axis;

providing the head with a plurality of resilient members parallel to the head plane, each resilient member extending radially outward from the coupling to a rim of the head, and each adjacent pair of resilient members defining an acute angle between them;

providing the head with a flexible receiving surface configured to receive a cleaning utility; and receiving the cleaning utility at the flexible receiving surface, such that a force applied to the second extension component is transmitted to the cleaning utility via the head to conform the cleaning utility to a remote surface to be cleaned.

17. The method of claim 16, wherein the coupling is rigid.

* * * * *